US009221283B1

(12) United States Patent
Hagiwara et al.

(10) Patent No.: US 9,221,283 B1
(45) Date of Patent: Dec. 29, 2015

(54) DETERMINATION APPARATUS AND DETERMINATION METHOD FOR DETERMINING REUSABILITY OF SHEET

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Takahiro Hagiwara, Chiba (JP); Shunichi Megawa, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/327,698

(22) Filed: Jul. 10, 2014

(51) Int. Cl.
*B41M 7/00* (2006.01)
*B41J 29/38* (2006.01)

(52) U.S. Cl.
CPC ..... *B41J 29/38* (2013.01); *B41M 7/009* (2013.01)

(58) Field of Classification Search
USPC ..... 347/179
See application file for complete search history.

(56) References Cited

U.S. PATENT DOCUMENTS

| | | | | |
|---|---|---|---|---|
| 6,891,640 | B2 * | 5/2005 | Kakikawa et al. | 358/1.9 |
| 2011/0310422 | A1 | 12/2011 | Hagiwara | |
| 2012/0038958 | A1 * | 2/2012 | Iguchi et al. | 358/505 |
| 2012/0149562 | A1 * | 6/2012 | Iguchi et al. | 503/201 |
| 2012/0189340 | A1 | 7/2012 | Hagiwara | |
| 2012/0257264 | A1 * | 10/2012 | Megawa | 358/505 |
| 2013/0070266 | A1 | 3/2013 | Hagiwara et al. | |
| 2013/0156458 | A1 * | 6/2013 | Suzuki | 399/81 |
| 2013/0242026 | A1 * | 9/2013 | Mizutani | 347/179 |

FOREIGN PATENT DOCUMENTS

| | | | | |
|---|---|---|---|---|
| JP | 2003-136811 | * | 5/2003 | B41J 29/36 |
| JP | 2007-007957 | * | 1/2007 | B41J 29/26 |

* cited by examiner

*Primary Examiner* — Huan Tran
(74) *Attorney, Agent, or Firm* — Amin, Turocy & Watson, LLP

(57) ABSTRACT

A determination apparatus comprises a memory and a controller. The memory stores the area data of a plurality of areas divided in a specific form. The controller acquires a scanned image after an erasing processing is carried out for a sheet on which the specific form is printed, determines the state of the sheet subjected to the erasing processing by differing a threshold value for each image area associated with the area data and determines whether or not the sheet is reusable based on the result of the determination.

10 Claims, 10 Drawing Sheets

DETERMINATION APPARATUS AND DETERMINATION METHOD FOR DETERMINING REUSABILITY OF SHEET

FIELD

Embodiments described herein relate to a technology of reusing a sheet by using a color-erasable material.

BACKGROUND

An erasing apparatus is known which erases an image recorded or printed on a sheet with a color-erasable material to reuse the sheet.

In the use of a system which reuses a sheet through an erasing apparatus, an image is printed on a sheet using a printing apparatus which uses a toner or ink composing of a color-erasable material, further, the sheet is filled out with a pen using a color-erasable material. After the sheet is used, the color material recorded on the sheet is erased using the erasing apparatus. After an erasing processing is carried out, the erasing apparatus checks an erasing state, determines the sheet as unsuitable for reuse if there is a defective part on the sheet such as a part is not fully erased and then discharges the sheet to a reject tray, or determines the sheet as suitable for reuse and then discharges the sheet to a reuse tray.

However, the conventional erasing apparatus determines a sheet having a defective part as unsuitable for reuse, which makes it impossible to increase the reuse rate of the sheet.

DETAILED DESCRIPTION

In accordance with embodiments described herein, a determination apparatus comprises a memory and a controller. The memory stores the area data of a plurality of areas divided in a specific form. The controller acquires a scanned image after an erasing processing is carried out for a sheet on which the specific form is printed. By differing a threshold value for each image area associated with the area data, the controller determines the state of the sheet subjected to the erasing processing. The controller determines whether or not the sheet is reusable based on the result of the determination.

The system described in embodiments has the following functions:

1: at least defining an area 'record with a color-erasable material' and an area 'the other' on a sheet, setting the erasing quality (including stain and the degree of the deterioration of the sheet) of each defined area, and determining whether or not the sheet is reusable.

2: for a form format formed with a color-inerasable material, masking the printing position by using original document data, and determining whether or not the sheet the other area of which other than the area recorded with the color-inerasable material is reusable.

3: recording a machine-readable code (e.g. barcode, QR code and the like) for recognizing the format, switching an erasing quality and an area according to the read machine-readable code, and then determining whether or not the sheet is reusable.

Embodiments described herein are described below.

Embodiment 1

Figure 1:
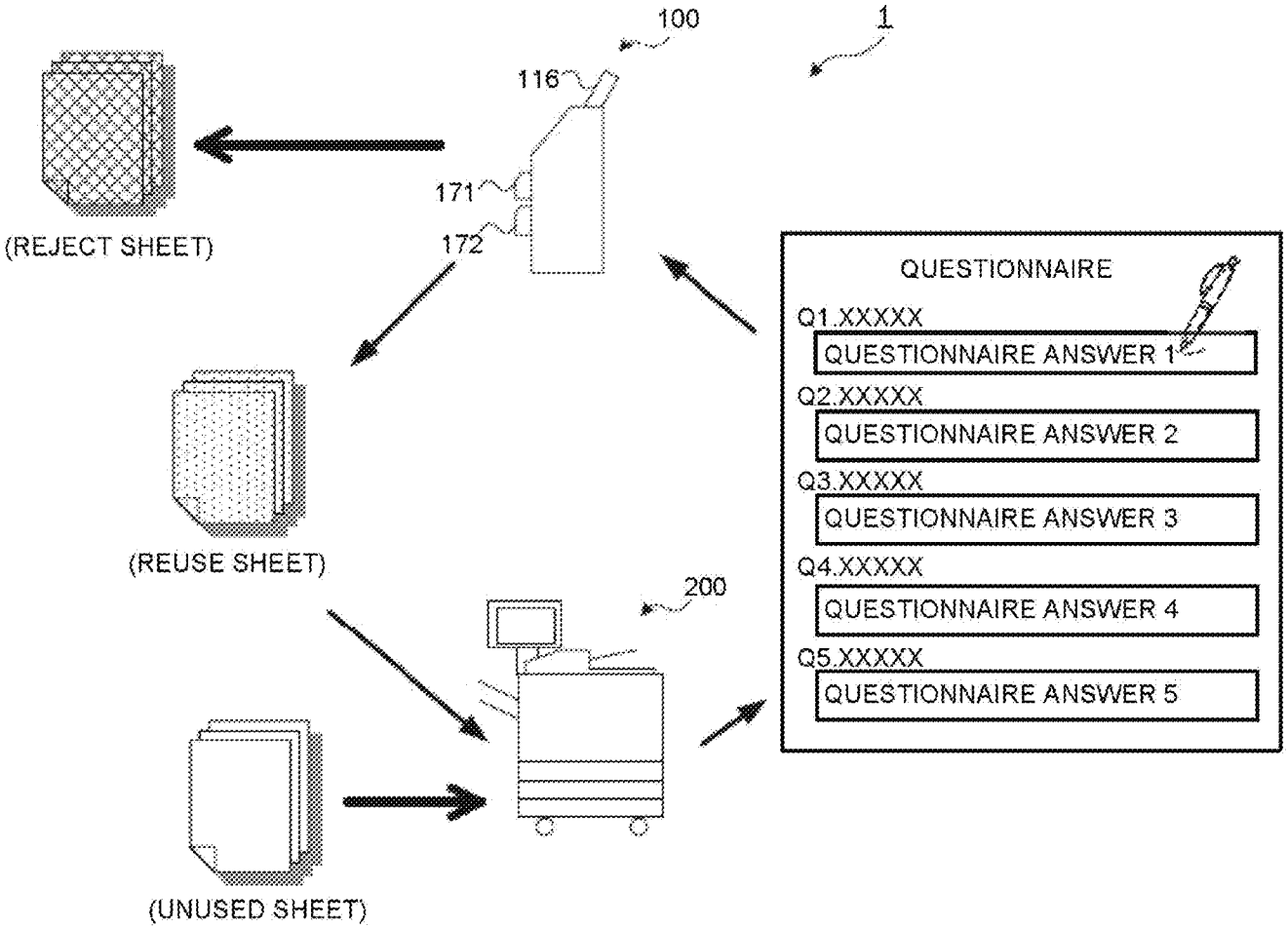
FIG. 1 is a diagram illustrating an example of the constitution of a system and schematically illustrating the use of a sheet according to an embodiment.

FIG. 1 is a diagram illustrating an example of the constitution and illustrating the schematic operations of a reuse system according to an embodiment. The reuse system 1 comprises an erasing apparatus 100 (determination apparatus) and an image forming apparatus 200.

The image forming apparatus 200 prints a form in a specific format such as a questionnaire. In embodiment 1, the image forming apparatus 200 prints using a color-erasable toner or ink. The questioned person fills in the questionnaire on the sheet with a pen using a color-erasable ink.

The erasing apparatus 100 reads and stores a questionnaire-filled sheet stacked in a feeding unit 116 and carries out an erasing processing for the sheet. The erasing apparatus 100 determines the state of the sheet, discharges the sheet to a reuse tray 171 after determining the sheet as suitable for reuse or to a reject tray 172 after determining the sheet as unsuitable for reuse for the reason of a stain or a poor erasing quality. The sheet discharged to the reuse tray 171 is reused by the image forming apparatus 200 to be printed using a color-erasable toner or ink along with unused sheets. On the other hand, the sheet discharged to the reject tray 172 is rejected.

Figure 2:
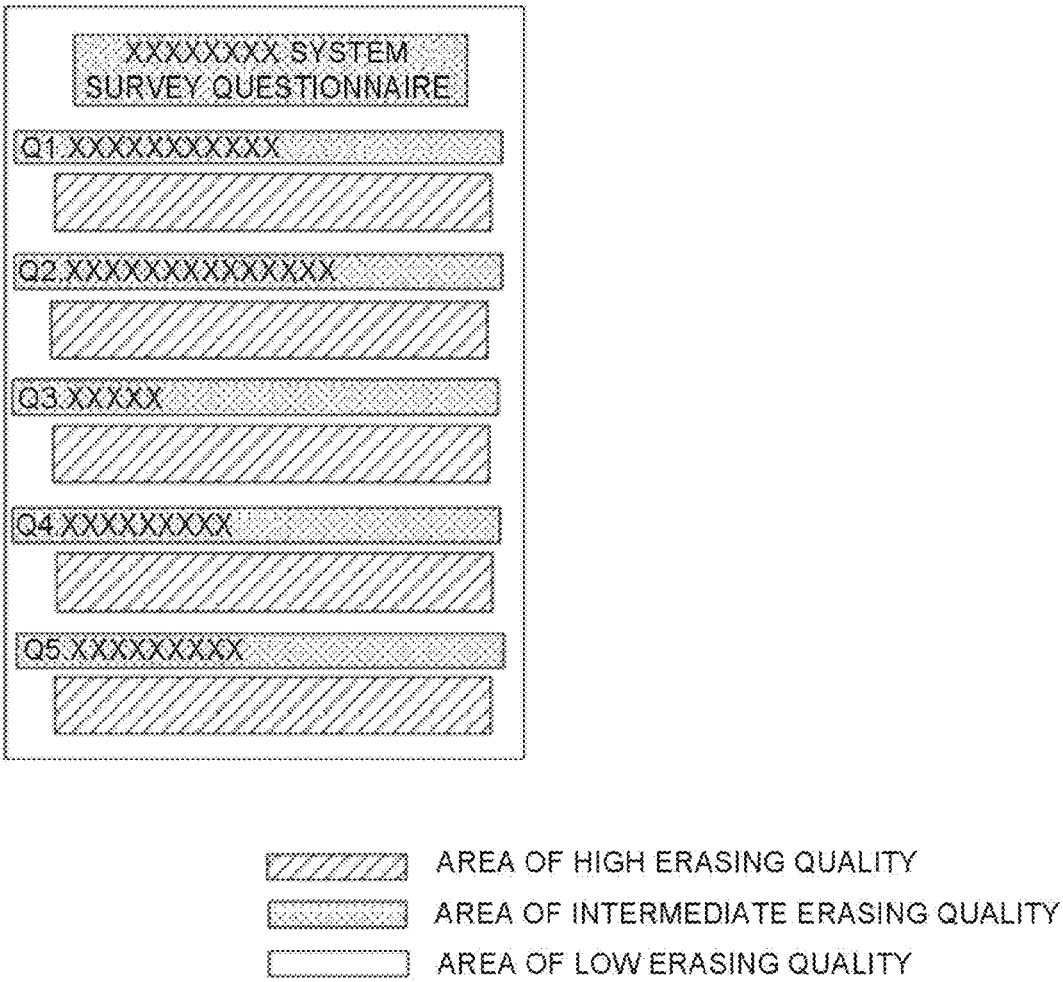
FIG. 2 is a diagram illustrating an example of the object area of each erasing quality when erasing qualities are classified.

In the embodiment, the format of a form to be printed is determined in advance. Thus, the usage forms of a sheet may be divided into several different ones as follows: a used part; an unused margin part (margin area); a used and readable part; and a part causing an influence to the reading of a machine. For example, in the case of the questionnaire sheet shown in FIG. 2, the area hatched by dots is an area in which the question content of a questionnaire is printed and which can be any readable area. The area hatched by slashes is an answer column and is an area causing an influence to the reading of a machine. Further, the margin area is the rest margin area, that is, an unused part. In this way, a sheet can be approximately divided into three categories of areas.

Then, in the embodiment, a required erasing level is set for each area of the three categories, and an erasing quality (it is set that the less the afterimage is, the higher the erasing quality at which a color-erasable material is erased is) is classified according to each area. A margin area, even if of a low quality, is allowed to be reused to increase the reuse rate of a sheet. That is, a sheet, the questionnaire on which is basically not influenced even if the other margin area of the sheet is stained or the other margin area of the sheet is not fully erased, is determined as suitable for reuse. If the question area (any readable part) of a questionnaire on a sheet, although slightly stained or left with a tiny image after an erasing processing, as long as it is still readable, then the sheet is determined as suitable for reuse. The answer column (the part influencing the reading of a machine) of a questionnaire, which greatly influences the reading accuracy of the machine, is required not to be stained as much as possible. Thus, a sheet is determined as unsuitable for reuse if the answer area of the sheet is not fully erased.

Figure 3:
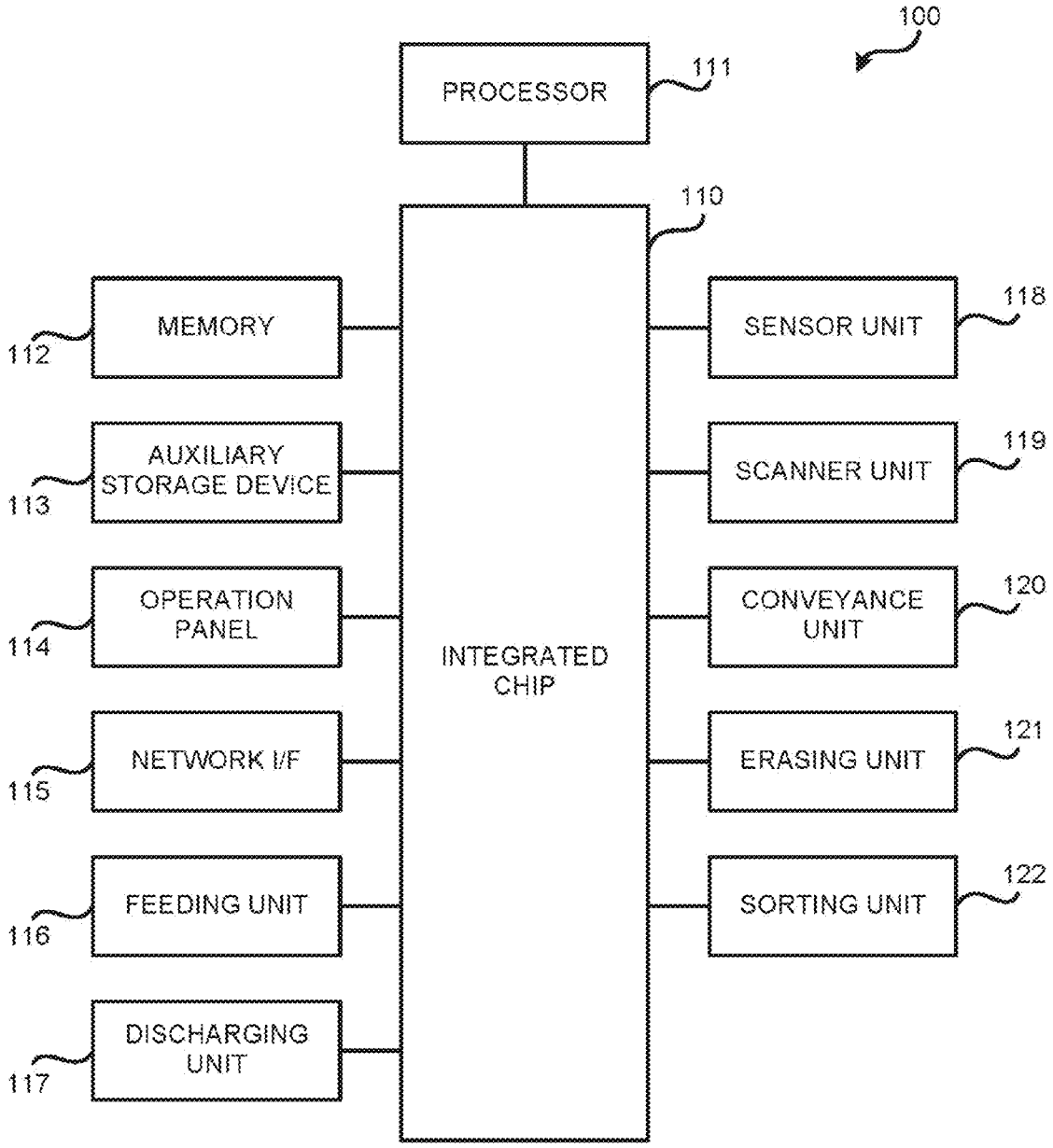
FIG. 3 is a block diagram illustrating an example of the constitution of an erasing apparatus.
Figure 4:
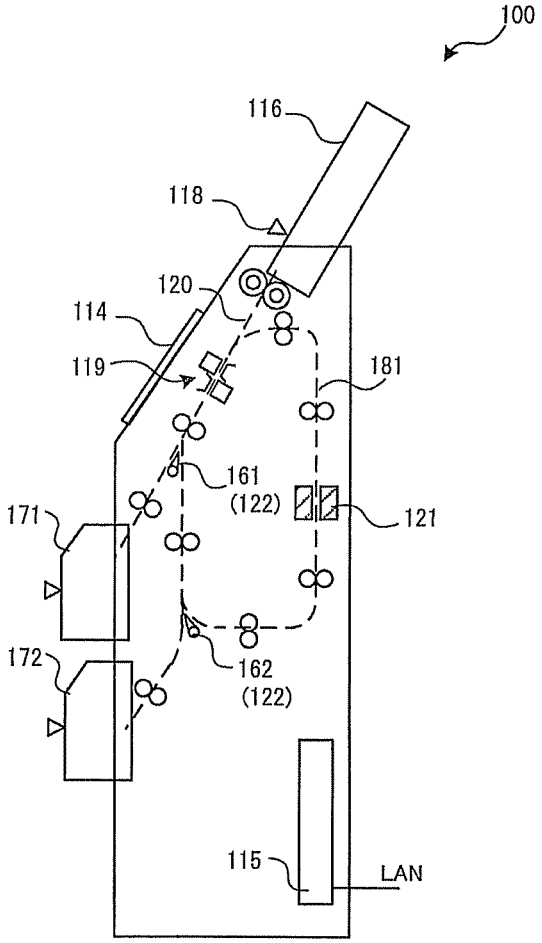
FIG. 4 is a diagram illustrating an arrangement example of the inside of an erasing apparatus according to embodiment 1.

Next, the constitution example of the erasing apparatus 100 is described with reference to FIG. 3 and FIG. 4. FIG. 3 is a block diagram illustrating the erasing apparatus 100, and FIG. 4 is a diagram illustrating an arrangement example of the hardware of the erasing apparatus 100. As shown in FIG. 3, the erasing apparatus 100 comprises a processor 111, a memory 112, an auxiliary storage device 113, an operation panel 114, a network I/F 115, a feeding unit 116, a discharging unit 117, a sensor unit 118, a scanner unit 119, a conveyance unit 120, an erasing unit (eraser) 121 and a sorting unit (sorter) 122, which are connected with an integrated chip 110 in a wired manner.

The processor 111, which is, for example, a CPU (Central Processing Unit), executes the programs pre-stored in the auxiliary storage device 113 to control each device inside the erasing apparatus 100. The memory 112 is a volatile primary storage device. The auxiliary storage device 113, which is, for example, a hard disk drive, is a nonvolatile auxiliary storage device. The auxiliary storage device 113 stores specific programs, form formats, area data, category data and the like for realizing the present embodiment.

The operation panel 114 is a touch panel display which is operated by the user and on which a message is displayed for the user. The network I/F 115 sends, for example, the image data read by the scanner unit 119 to an external file server and the like. The feeding unit 116 is a tray on which questionnaire-filled sheets are loaded. The discharging unit 117 is a unit in which a sheet subjected to an erasing processing is housed, and in embodiment 1, the following two trays are arranged: a reuse tray 171 for housing a sheet determined as suitable for reuse and a reject tray 172 for housing a sheet determined as unsuitable for reuse, as shown in FIG. 4.

The sensor unit 118 detects whether or not a sheet is fed by the feeding unit 116. Further, a plurality of sensor units may be arranged on a conveyance path inside the apparatus, and whether or not a sheet passes the positions of the sensor units is detected. The scanner unit 119, which is provided with light-emitting elements and CCD image sensors, irradiates two sides of a sheet conveyed thereto using the light-emitting elements and captures an image of the sheet using two CCD image sensors which are arranged across a conveyance path. In this manner, the images of the two sides of the conveyed sheet can be photographed in a single conveyance. Further, the images are photographed twice before an erasing processing and after the erasing processing. The processor 111 stores and accumulates image data in the auxiliary storage device 113 prior to an erasing processing and determines the result of the erasing processing and whether or not the stain is acceptable using the image data after the erasing processing.

The conveyance unit 120 comprises a conveyance roller and a conveyance path. The conveyance unit 120 conveys the questionnaire-filled sheet loaded in the feeding unit 116 into the apparatus along a conveyance path starting from the scanner unit 119 (first time), passing through the erasing unit 121, the scanner unit 119 (second time) and the sorting unit 122, and ending at the discharging unit 117. The conveyance unit 120 has a circulation path 181 (refer to FIG. 4) which is branched off from the downstream side of the scanner unit 119 and merged with the main stream at the upstream side of the scanner unit 119 and on which the erasing unit 121 is arranged.

The erasing unit 121 comprises two heating elements for heating and erasing a sheet conveyed thereto at a given temperature. Two heating elements are arranged across a conveyance path, one for heating a first side of a sheet, and the other one for heating a second side of the sheet. In this way, an erasing processing is carried out once for both sides of a sheet conveyed thereto.

The sorting unit 122 comprises a flapper 161 and a flapper 162 which are arranged at the branching points where a sheet is determined to be conveyed towards the tray 171 or the tray 172 of the discharging unit 117 and motors for driving the flappers 161 and 162. The sorting unit 122 controls either one of trays of the discharging unit 117 to which a sheet is discharged according to the result of the determination on the reusability of the sheet.

The integrated chip 110 is connected with each aforementioned unit in a wired manner to transmit signals and data among the units.

Figure 5:
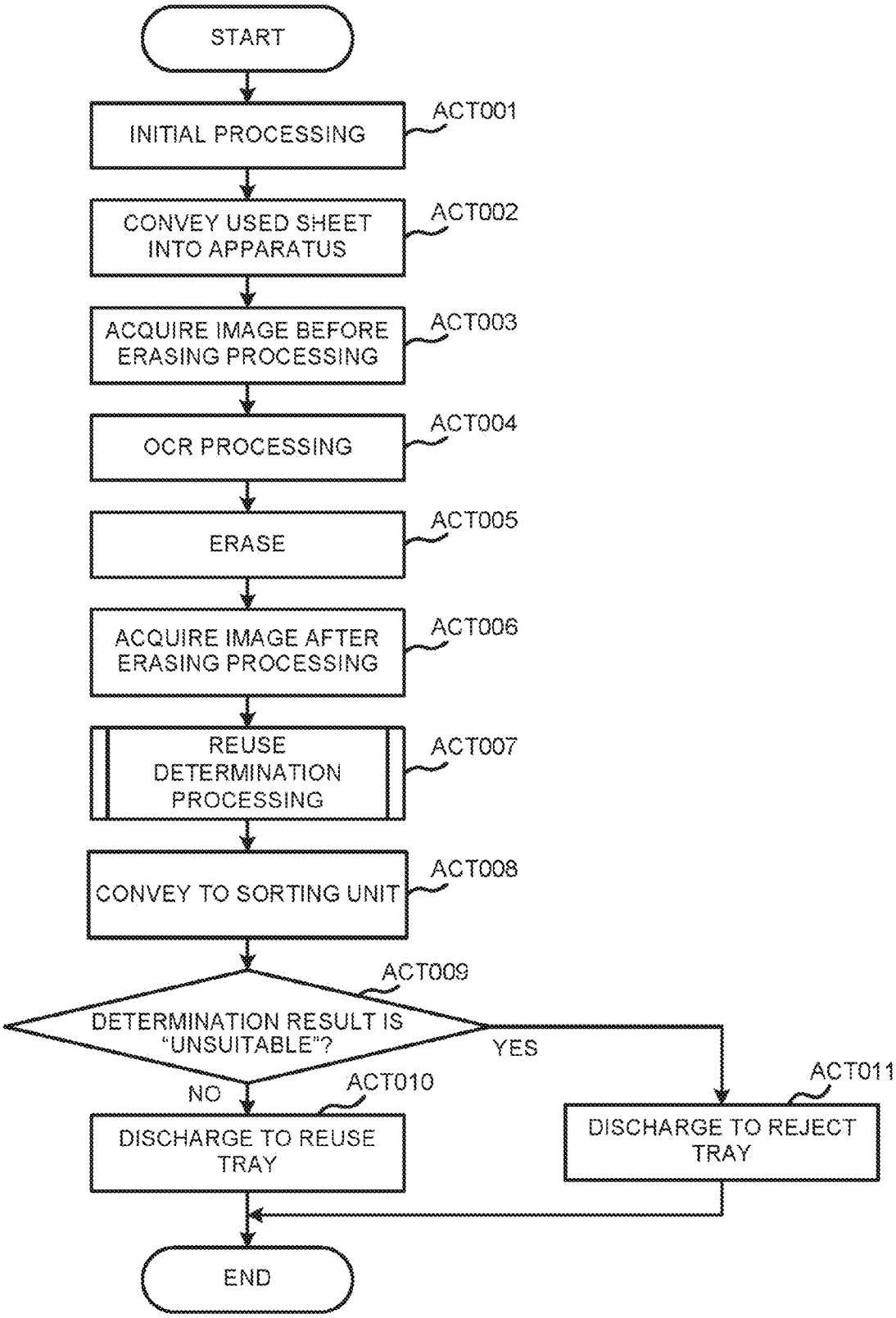
FIG. 5 is a flowchart illustrating an example of the entire operation of the erasing apparatus according to embodiment 1.

Next, the flow of the operations of the erasing apparatus is described below with reference to FIG. 5. The operation steps shown in FIG. 5 are realized by expanding and executing, on the memory 112, the program which is stored in the auxiliary storage device 113 for use by a reuse system and is read by the processor 111 of the erasing apparatus 100, and through the operations of each piece of hardware according to a control instruction from the processor 111.

The processor 111 starts the program by taking the operation on a specific button (e.g. start button) on the operation panel 114 as a trigger to guarantee a work area for the memory 112 and carry out initial setting on each parameter and the like (ACT 001). The conveyance unit 120 conveys a sheet loaded on the feeding unit 116 into the apparatus (ACT 002), and the scanner unit 119 optically reads the image recorded on the sheet (ACT 003). The read image is stored in the auxiliary storage device 113. The processor 111 carries out a recognition processing or an OCR (Optical Character Recognition) processing to recognize the checked items in the question columns of a questionnaire and obtains the answers after converting the answers into text data (ACT 004). Sequentially, the sheet is conveyed to the circulation path 181 and sent to the erasing unit 121. The erasing unit 121 heats and erases the image recorded on the sheet (ACT 005). The sheet subjected to the erasing processing is conveyed to the scanner unit 119 again. The scanner unit 119 optically reads the sheet and stores the read data in the memory 112 (ACT 006), and the processor 111 determines a sheet condition such as whether or not the image on the sheet is erased (ACT 007). The reuse determination processing of the sheet will be described later.

The sheet is conveyed to the sorting unit 122 (ACT 008). After determining the sheet as suitable for reuse (NO in ACT 009), the sorting unit 122 guides the sheet to the reuse tray 171 of the discharging unit 117 (Act 010). On the other hand, after determining the sheet as unsuitable for reuse (YES in ACT 009), the sorting unit 122 guides the sheet to the reject tray 172 of the discharging unit 117 (ACT 011).

The aforementioned operations are repeated until there is no sheet in the feeding unit 116.

Figure 6:
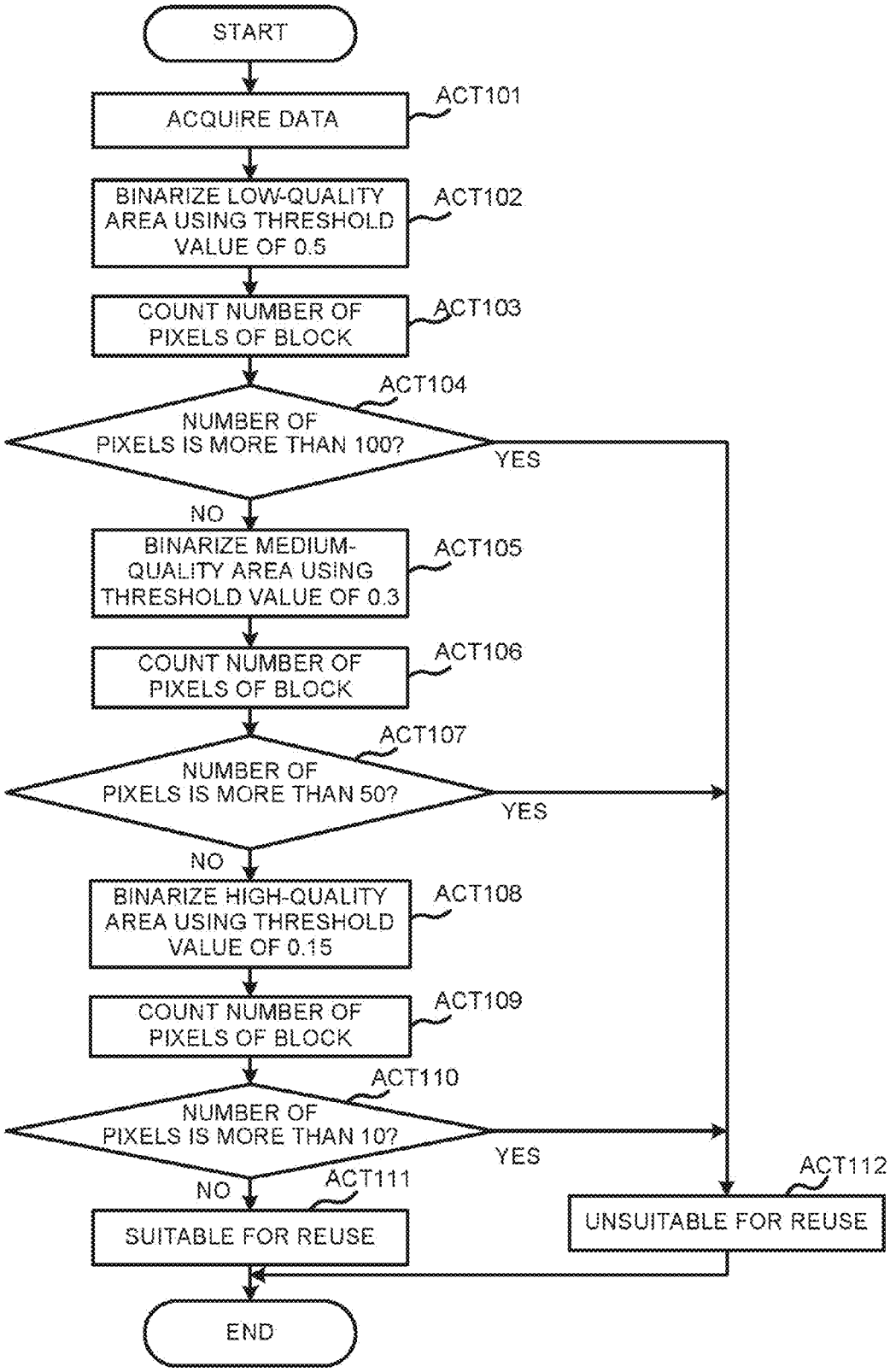
FIG. 6 is a flowchart illustrating an example of the operations of a reuse determination processing carried out in embodiment 1.

Next, the reuse determination processing carried out in ACT 007 is described below with reference to the flowchart of FIG. 6. In the reuse determination processing, the processor 111 checks the condition of the sheet according to a preset sheet area and three categories of erasing qualities.

The processor 111 acquires a sheet area (area data) and the erasing quality value (category data) on the sheet area and acquires the color-erased image obtained by the scanner unit 119 (ACT 101). The sheet area is the coordinate values (the points at the four corners of a rectangular area), for example, based on a base point of the left upper point of the image, and the erasing quality value is a value associated with the coordinate values. In this example, a numeral 0 is assigned to an area of a low erasing quality, a numeral 1 is assigned to an area of an intermediate erasing quality, and a numeral 2 is assigned to an area of a high erasing quality. Further, in some cases, it is complicated to designate a sheet area such as the margin area shown in FIG. 2 using a rectangular area. Thus, in the embodiment, an area different from an area of an intermediate erasing quality and an area of a high erasing quality may be set as an area of a low erasing quality.

For an area of a low erasing quality, the processor 111 carries out a binarization processing for the brightness of the color-erased image using a threshold value of 0.5 (ACT 102). In this example, the brightness of the color-erased image is a value ranged from 0 to 1 to serve as a gray value which represents white when being 0 and black when being 1. In ACT 102, through the binarization processing using a threshold value of 0.5, the brightness above 0.5 is considered as a gray value '1' (black) and the brightness below 0.5 is considered as a gray value '0' (white).

The processor 111 counts the number of pixels of a block (hereinafter referred to as a cluster) the brightness of which is 1 (ACT 103) and compares the pixel number with a first given value (e.g. a numeral 100) (ACT 104). If the pixel number is above the first given value (YES in ACT 104), the processor 111 determines that the sheet reuse determination result is 'unsuitable for reuse' (ACT 112).

If the pixel number is below the first given value (NO in ACT 104), the processor 111 carries out, for an area of an intermediate erasing quality, a binarization processing for the brightness of the color-erased image using a threshold value of 0.3 (ACT 105). The processor 111 counts the number of pixels of a cluster the brightness of which is 1 and compares the pixel number with a second given value (e.g. a numeral 50) (ACT 107). If the pixel number is above the second given value (YES in ACT 107), the processor 111 determines that the sheet reuse determination result is 'unsuitable for reuse' (ACT 112).

If the pixel number is below the second given value (NO in ACT 107), the processor 111 carries out, for an area of a high erasing quality, a binarization processing for the brightness of the color-erased image using a threshold value of 0.15 (ACT 108). The processor 111 counts the number of pixels of a cluster the brightness of which is 1 (ACT 109) and compares the pixel number with a third given value (e.g. a numeral 10) (ACT 110). If the pixel number is above the third given value (YES in ACT 110), the processor 111 determines that the sheet reuse determination result is 'unsuitable for reuse' (ACT 112).

If the pixel number is below the third given value (YES in ACT 110), the processor 111 determines that the sheet reuse determination result is 'suitable for reuse' (ACT 111) as all the areas are suitable for this category.

As stated above, as a method for determining the level of erasing quality, the level of erasing quality may be determined using the size of a detected cluster after the brightness of an image is binarized. Apart from this, it may be embodied that a processing of excluding a specific color may be added or the distribution direction and the length of clusters, instead of the size of the clusters, are considered to determine the level of erasing quality. Further, the front and rear surfaces of the clusters and vertical and lateral orientations may be considered to determine the level of erasing quality. In a word, by setting areas and erasing qualities according to the use purpose of a sheet, the reuse rate of the sheet is increased when compared with the uniform setting of the erasing quality for the whole sheet.

Embodiment 2

It is described in embodiment 1 that a questionnaire form is printed by the image forming apparatus 200 with a color-erasable material, the questionnaire sheet is filled out with a pen using a color-erasable ink, the answers are read and stored by an erasing apparatus 100, and then the erasing apparatus 100 erases the questionnaire sheet. Thus, not only the answers filled out on the sheet with a pen but also the form is subjected to an erasing processing. In embodiment 2, it is described that the image forming apparatus 200 prints a questionnaire form with a color-inerasable material and the questionnaire sheet is filled out with a pen using a color-erasable ink. Thus, in embodiment 2, only the manually written answer is erased through an erasing processing while the questionnaire form is retained for further use. Further, in embodiment 2, it is also described the classification of a plurality of forms (in this example, of two patterns) and the following discharging method of the forms.

In embodiment 2, the format of a form to be printed is determined in advance, like in embodiment 1. Further, like in embodiment 1, the usage forms of a sheet are divided into several different ones as follows: a used part, an unused part, a used and readable part, and a part causing an influence to the reading of a machine. Thus, whether or not a sheet is reusable can be determined according to preset areas and erasing qualities.

Figure 7:
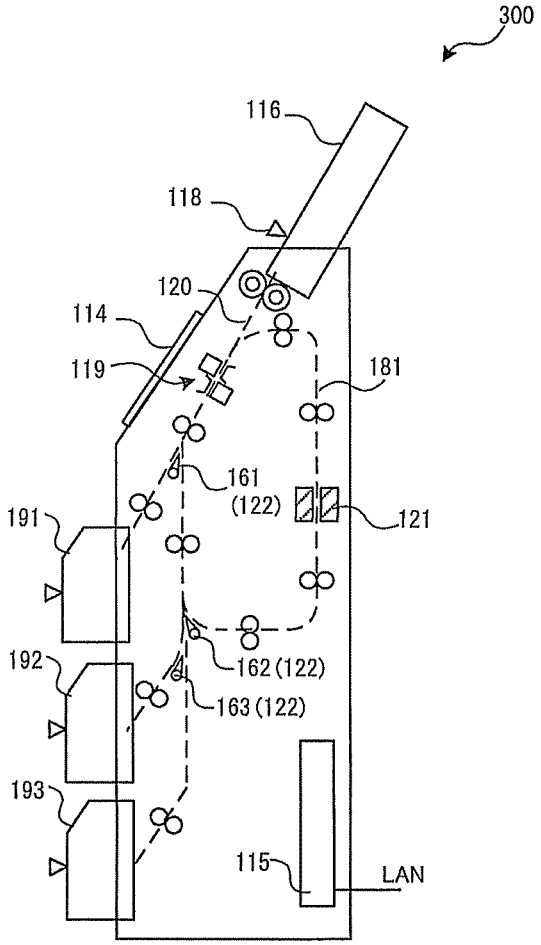
FIG. 7 is a diagram illustrating an arrangement example of the inside of an erasing apparatus according to embodiment 2.

FIG. 7 is a diagram illustrating an arrangement example of the hardware of embodiment 2. In accordance with embodiment 2, an erasing apparatus 300 comprises a first reuse tray 191, a second reuse tray 192 and a reject tray 193. Sheets determined as suitable for reuse can be discharged to the first reuse tray 191 and the second reuse tray 192. Sheets classified into different forms are discharged to the first reuse tray 191 and the second reuse tray 192, respectively. A sheet determined as unsuitable for reuse in the way described in embodiment 1 is discharged to the reject tray 193. As a discharging tray is increased in embodiment 2 when compared with in embodiment 1, one more branching point is also set in a conveyance path in embodiment 2, and a flapper 163 is arranged at the added branching point. The other structure of embodiment 2 is the same as that of embodiment 1. Further, the block diagram of the erasing apparatus described in embodiment 2 is the same as that of the erasing apparatus described in embodiment 1 with the same reference symbols denoting the same units (refer to FIG. 4).

Figure 8:
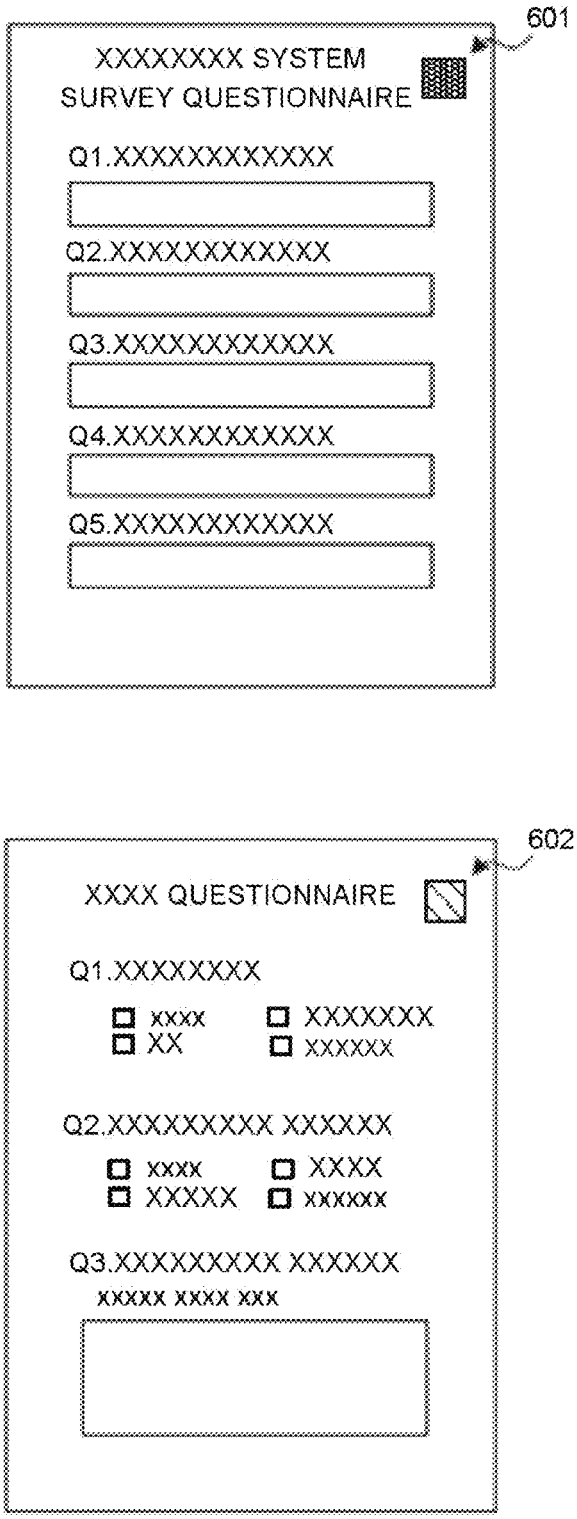
FIG. 8 is a diagram illustrating examples of a sheet on which a QR code is attached according to different form.

In embodiment 2, the image forming apparatus 200 prints a questionnaire form with a color-inerasable material. Further, in embodiment 2, a plurality of printed questionnaire forms are prepared, and a QR code for detecting the classification of a form is attached on a sheet when the sheet is printed. FIG. 8 shows an example of each pattern of a form on which a QR code is attached. As shown in FIG. 8, for a form of a different pattern, the image forming apparatus 200 adds a different corresponding QR code 601 or 602 on a margin part. The QR code 601 or 602 is printed with a color-inerasable material.

Figure 9:
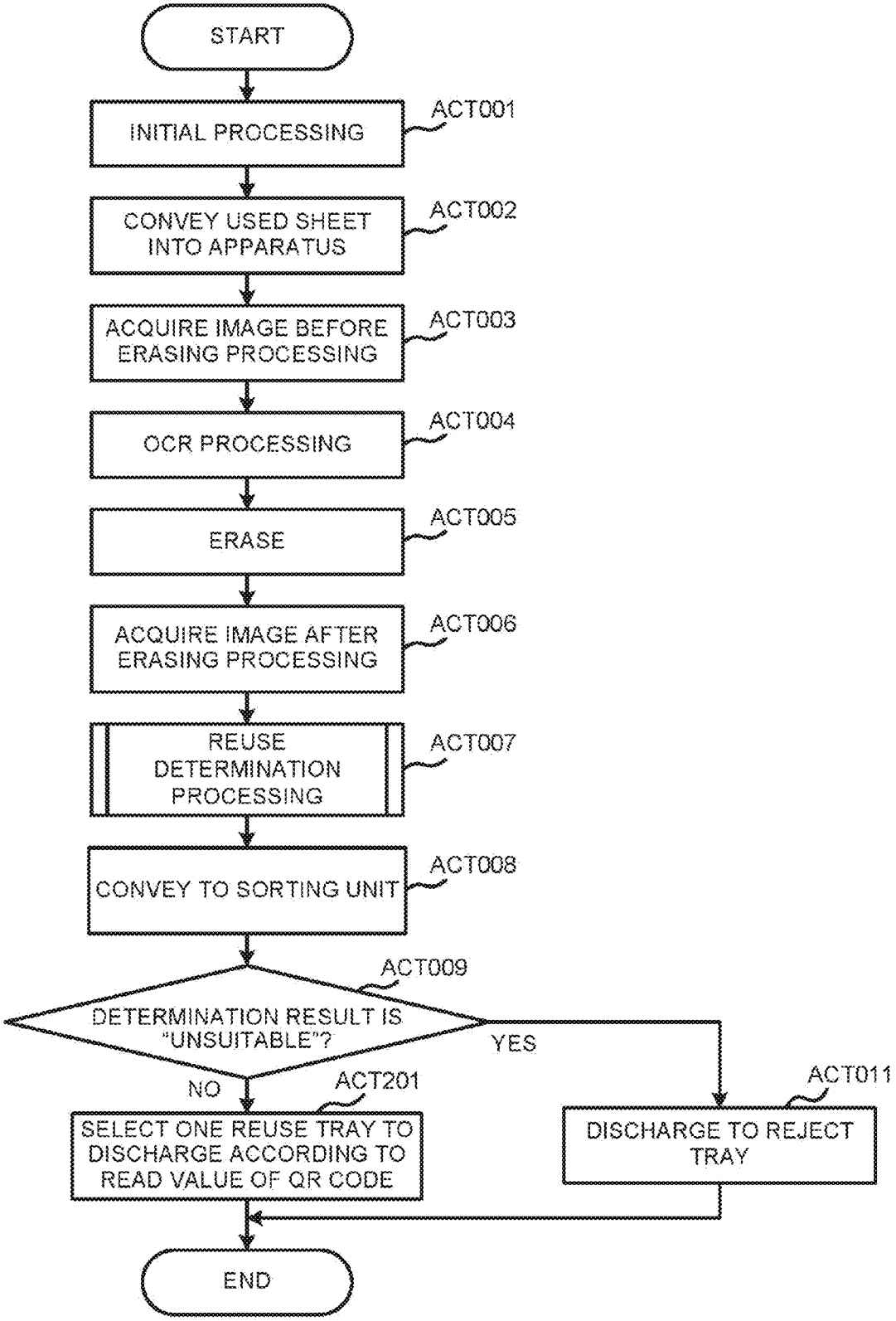
FIG. 9 is a flowchart illustrating an example of the entire operation of the erasing apparatus according to embodiment 2.

The erasing apparatus 300 sorts different form sheets according to the QR code and then discharges the form sheets. FIG. 9 shows an example of the entire operation of the erasing apparatus 300. In embodiment 2, the operations in ACT 001-ACT 009 are the same as those described in embodiment 1. In ACT 009, if the determination result is 'unsuitable for reuse' (YES in ACT 009), the sorting unit 122 guides the sheet to the reject tray 193 (ACT 011). If the determination result is 'suitable for reuse' (NO in ACT 009), the processor 111 reads a QR code from the image of the scanned sheet and controls the sorting unit 122 to guide the sheet to either of the first reuse tray 191 and the second reuse tray 192 according to the read value (ACT 201). For example, in the case of the QR code 601 shown on the upper part of FIG. 8, the processor 111 controls the sorting unit 122 to guide the sheet to the first reuse tray 191. In the case of the QR code 602 shown on the lower part of FIG. 8, the processor 111 controls the sorting unit 122 to guide the sheet to the second reuse tray 192.

Figure 10:
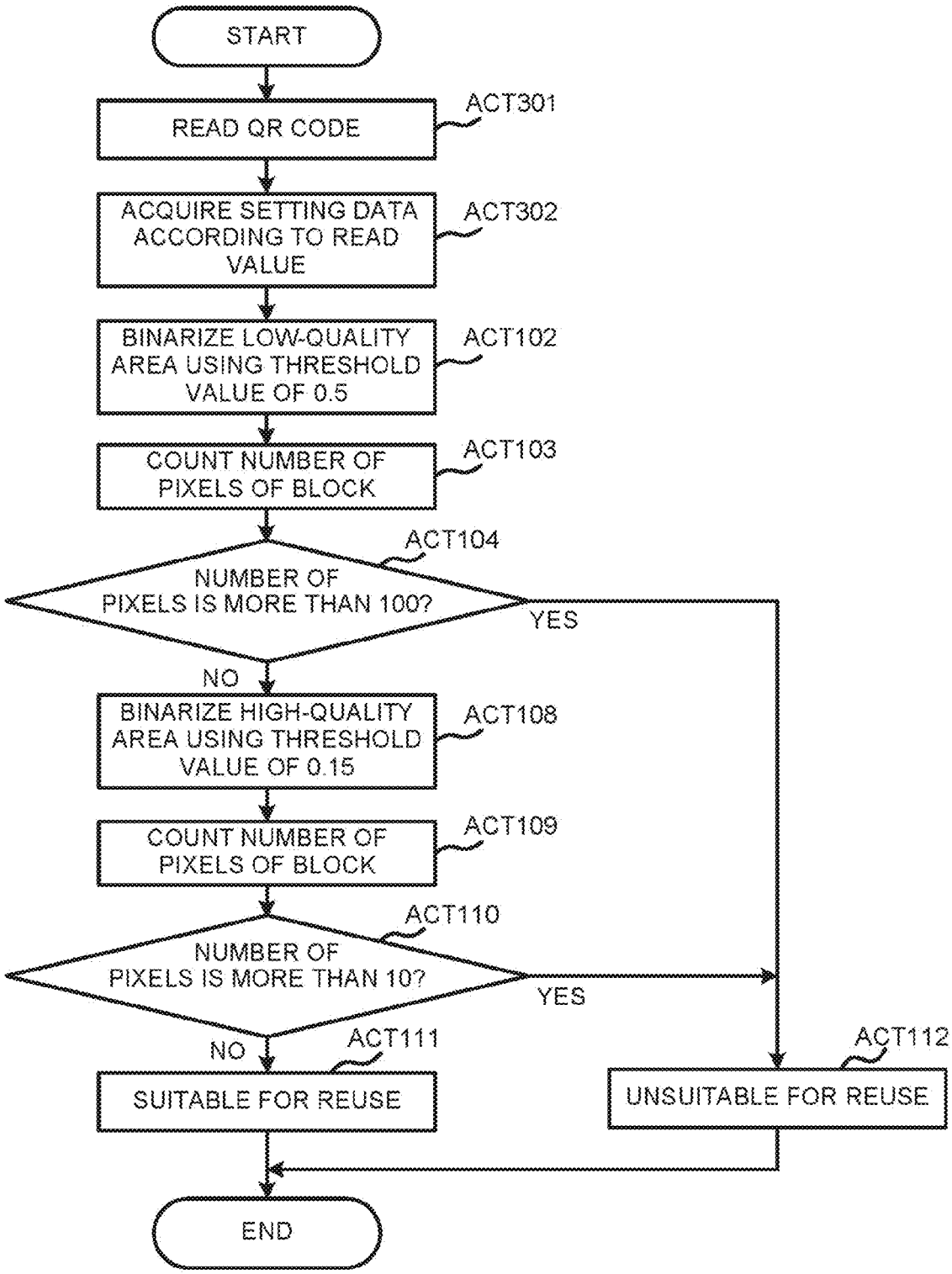
FIG. 10 is a flowchart illustrating an example of the operations of a reuse determination processing carried out in embodiment 2.

As a color-inerasable material is used and a plurality of forms are processed in embodiment 2, the reuse determination processing carried out in embodiment 2, which is different from that described in embodiment 1, is described below with reference to the flowchart of FIG. 10.

The processor 111 reads a QR code from the color-erased image (ACT 301) to obtain the setting data (area data, category data) corresponding to the read value. In embodiment 2, for each read value of QR code, there is corresponding area data and category data which are stored in the auxiliary storage device 113 in advance. The processor 111 acquires the area data and category area corresponding to the value of the QR code read in ACT 301.

For an area of a high erasing quality and an area of a low erasing quality, the processor 111 carries out the determination processing the same as that described in embodiment 1. On the other hand, as the area of an intermediate erasing quality is the question content area which cannot be erased, a control is carried out to mask the area so that no determination processing is carried out for the area. That is, the operations carried out in embodiment 2 and shown in FIG. 10 are the operations left from the removal of ACT 105-ACT 107 from those shown in the flowchart of FIG. 6 described in embodiment 1. Thus, if the result of the determination on the area of a low erasing quality carried out in ACT 104 is 'NO' (NO in ACT 104), then ACT 108 is carried out to make a determination on the area of a high erasing quality.

Thus, in embodiment 2, the pattern and the erasing quality of a sheet area can be switched according to a form. Moreover, each form can be sorted by setting a plurality of discharging destinations.

In embodiment 2, by determining whether or not there is a QR code on the image on a sheet subjected to an erasing processing and the read value of the QR code, a reuse system is constituted which is capable of sorting a sheet completely printed using a color-erasable material from a sheet printed using a color-inerasable material even if the sheets are mixed.

The format of a form on which no machine-readable code such as a QR code or a barcode is attached may be determined, and then sheets are sorted and discharged.

Whether or not a preset area can be reused may also be determined by taking the orientations and the front and rear surfaces of a sheet into consideration. Further, in each aforementioned embodiment, whether or not a sheet is reusable is determined according to the brightness; however, whether or not a sheet is reusable may also be determined by removing a stain greatly different in the hue and the saturation of the used color-erasable material in the reuse determination processing.

With such a structure, in a reuse system using a color-erasable material, whether or not the sheet is reusable can be determined according to the area information of a sheet set by limiting the use method of a sheet in advance and corresponding erasing quality information, which increases the reuse rate of the sheet and constitutes a sheet reuse system using a color-inerasable material.

According to the embodiments described herein, the reuse rate of a sheet can be increased.

In the foregoing embodiments, it is described that a sorting determination processing is carried out in the erasing apparatus; however, the sorting determination processing may also be carried out by a computer provided with a processor, a memory and an auxiliary storage device.

In the embodiments, any of the processes described above can be accomplished by a computer-executable program, and this program can be embodied in a non-transitory computer-readable memory device. In the embodiments, the memory device, such as a magnetic disk, a flexible disk, a hard disk, an optical disk (CD-ROM, CD-R, DVD, and so on), an optical magnetic disk (MD and so on) can be used to store instructions for causing a processor or a computer to perform the processes described above. Furthermore, based on an instruction in the installed program, an OS (operating system) of the computer, or MW (middleware software), such as database management software or network, may execute one or more parts of the processes described above to realize the embodiments.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A determination apparatus, comprising:

a memory configured to store the area data of a plurality of areas divided in a specific form; and a controller configured to acquire a scanned image after an erasing processing is carried out for a sheet on which the specific form is printed, determine the state of the sheet subjected to the erasing processing by differing a threshold value for each image area associated with the area data and determine whether or not the sheet is reusable based on the result of the determination.

2. The determination apparatus according to claim 1, wherein the area data are the data which represent the positions of an unused margin area and the other areas; and the controller relaxes the threshold value of the margin area with respect to those of the other areas and then determines the state of the sheet so that the result of the determination on the sheet state of the margin area is likely to be 'good'.

3. The determination apparatus according to claim 1, wherein the area data is data represents positions of a text area where texts are printed, a filling area for the user of the sheet to fill in and the margin area; and the controller determines the state of the sheet after relaxing the threshold value of the margin area with respect to that of the text area so that the result of the determination on the sheet state of the margin area is likely to be 'good' and strictly setting the threshold value of the filling area with respect to that of the text area so that the result of the determination on the sheet state of the filling area is likely to be 'bad'.

4. The determination apparatus according to claim 1, wherein the determination apparatus comprises an eraser for erasing the image formed on the sheet by heating the sheet.

5. The determination apparatus according to claim 4, further comprising:

a plurality of dischargers configured to store sheets subjected to the erasing processing; and a sorter configured to switch the conveyance path so as to convey, according to the result of the determination carried out by the controller on the reusability of the sheet, a rejected sheet to an optional one of the plurality of the dischargers, and a reusable sheet to another discharger.

6. The determination apparatus according to claim 5, wherein the specific form has a plurality of patterns;

the controller further detects the form pattern on the sheet; and the sorter switches the conveyance path so as to convey a reusable sheet to the dischargers after sorting the reusable sheet according to the pattern detected by the controller.

7. The determination apparatus according to claim 6, wherein a machine-readable code representing a form pattern is attached on the sheet;

the controller reads the machine-readable code from the scanned image; and the sorter switches the conveyance path according to the value read by the controller.

8. The determination apparatus according to claim 5, wherein the memory stores the area data according to each form pattern; and the controller acquires the area data after switching an area according to the form pattern and determines the state of the sheet using the acquired area data.

9. A determination method, comprising:

storing the area data of a plurality of areas divided in a specific form;

acquiring a scanned image after an erasing processing is carried out for a sheet on which the specific form is printed;

acquiring, from a memory, the area data of the plurality of areas divided in the specific form;

determining the state of the sheet subjected to the erasing processing by differing a threshold value for the image areas associated with the area data; and determining whether or not the sheet is reusable based on the determination result.

10. The determination method according to claim 9, wherein the area data is the data which represent the positions of an unused margin area and the other areas; and the state of the sheet is determined after the threshold value of the margin area is relaxed with respect to those of the other areas so that the result of the determination on the sheet state of the margin area is likely to be 'good'.

* * * * *